United States Patent [19]

Hurd et al.

[11] 4,242,846

[45] Jan. 6, 1981

[54] MOTORCYCLE GARAGE

[76] Inventors: Roger B. Hurd, 21 Lake Ave., Apt. 1A, East Brunswick, N.J. 08816; Roosevelt N. Barbosa, 275 N. Field Ave., West Orange, N.J. 07052

[21] Appl. No.: 51,792

[22] Filed: Jun. 25, 1979

[51] Int. Cl.[3] ..... E04B 1/346

[52] U.S. Cl. ..... 52/71; 52/64

[58] Field of Search ..... 52/71, 79.1, 64

[56] References Cited

U.S. PATENT DOCUMENTS

| | | | |
|---|---|---|---|
| 2,883,713 | 4/1959 | Zug | 52/71 |
| 3,044,129 | 7/1962 | Bigelow | 52/71 X |
| 4,027,912 | 6/1977 | Pacca | 52/64 X |
| 4,035,964 | 7/1977 | Robinson | 52/71 X |
| 4,112,633 | 9/1978 | Mitchell | 52/71 X |

*Primary Examiner*—Carl D. Friedman

*Attorney, Agent, or Firm*—Arthur L. Lessler

[57] ABSTRACT

A motorcycle garage having a truncated pyramidal structure comprising four foldable panel members which can be folded into and out of an open rectangular frame which is portable. The members are detachably interlocked by latches, with the side members rolling on ball bearing detent supports. Front and rear doors provide access to the interior of the motorcycle enclosure, and vents in the doors minimize interior heat accumulation and moisture condensation.

12 Claims, 13 Drawing Figures

MOTORCYCLE GARAGE

This invention relates to a portable motorcycle garage, of the type which can be transported by one or two individuals and without special handling equipment.

Motorcycle garages are known in the art, as exemplified by U.S. Pat. Nos. 3,861,092; 3,945,159; 3,949,528; and 3,996,704, which show various types of rigid housing motorcycle garages. Of these, U.S. Pat. No. 3,861,092 shows an arrangement in which the housing is pivoted to the floor, and the motorcycle is driven onto the floor, with the entire upper portion of the housing subsequently being pivoted to enclose the motorcycle.

U.S. Pat. No. 3,407,546 shows an accordian-like construction for a shelter using rigid sheet material, comprising a polyurethane core with corrugated paper skins.

The various motorcycle garage arrangements heretofore known, however, are not readily portable, are cumbersome to assemble and disassemble, and require relatively expensive manufacturing techniques.

Accordingly, an object of the present invention is to provide an improved motorcycle garage which overcomes one or more of the aforementioned deficiencies of prior art structures.

As herein described, there is provided a portable enclosure, comprising: an open rectangular frame having vertical left and right side walls and horizontal top and bottom walls, a vertical open front surface and a vertical rear surface; first vertically oriented hinge means mounted within said frame adjacent said left side wall; second vertically oriented hinge means mounted within said frame adjacent said right side wall, said first and second hinge means being disposed different distances from said front surface; third horizontally oriented hinge means mounted within said frame adjacent said top wall; fourth horizontally oriented hinge means mounted within said frame adjacent said bottom wall, said third and fourth hinge means being disposed different distances from said front surface; a roof member comprising first and second generally rectangular panels hinged together by a roof hinge parallel to said third hinge means, an edge of said first panel being attached to said third hinge means; a floor member comprising third and fourth generally rectangular panels hinged together by a floor hinge parallel to said fourth hinge means, an edge of said third panel being attached to said fourth hinge means; a left side member comprising fifth and sixth panels hinged together by a left side hinge parallel to said first hinge means, an edge of said fifth panel being attached to said first hinge means, said fifth panel being generally trapezoidal and said sixth panel being quadrilateral; a right side member comprising seventh and eighth panels hinged together by a right side hinge parallel to said second hinge means, an edge of said seventh panel being attached to said second hinge means, said seventh panel being generally trapezoidal and said eighth panel being quadrilateral; a front panel hinged to one of said sixth and eighth panels by a front hinge parallel to a corresponding one of said first and second hinge means; latching means for detachably securing to each other adjacent edges of said panels to form an enclosure having a front end defined by said front panel and a rear end defined by said frame; and means for closing the rear surface of said frame; said hinge means and panels being positioned and dimensioned to fold into said frame with one of said panels being relatively proximate to said front vertical surface and providing a closure therefor. dr In the drawing:

FIG. 1*a* is a perspective view showing the front surface, left side and top of a motorcycle garage according to a preferred embodiment of the invention, in closed configuration for transportation purposes;

FIG. 1*b* is a perspective view showing the other three surfaces of the garage of FIG. 1*a;*

FIG. 2*a* is a perspective view of said motorcycle garage in a state of partial erection;

FIG. 2*b* is a partial cross-sectional view of the hinge arrangement between the floor panels shown in FIG. 2*a;*

FIG. 3*a* is a front elevation view of the frame of the motorcycle garage shown in FIGS. 1*a,* 1*b* and 2*a;*

FIG. 3*b* is a side elevation view showing the floor and roof hinge arrangement with the frame;

Figure 1A:
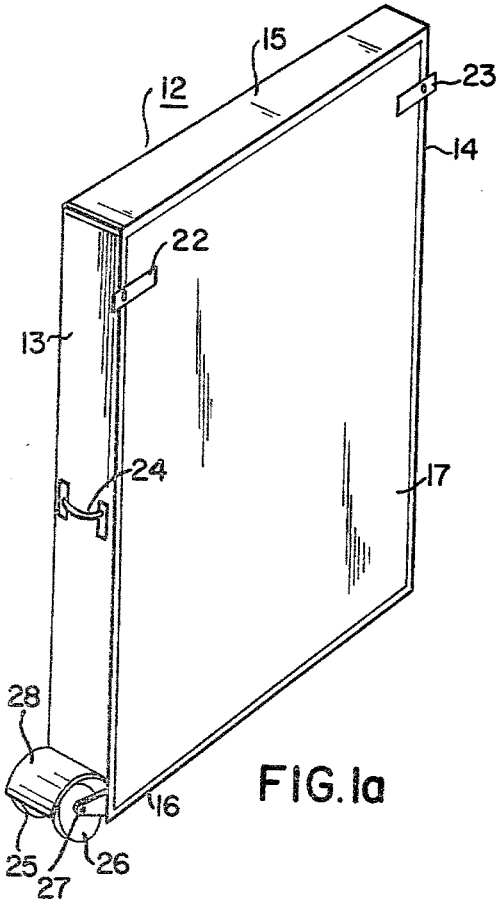
Figure 1B:
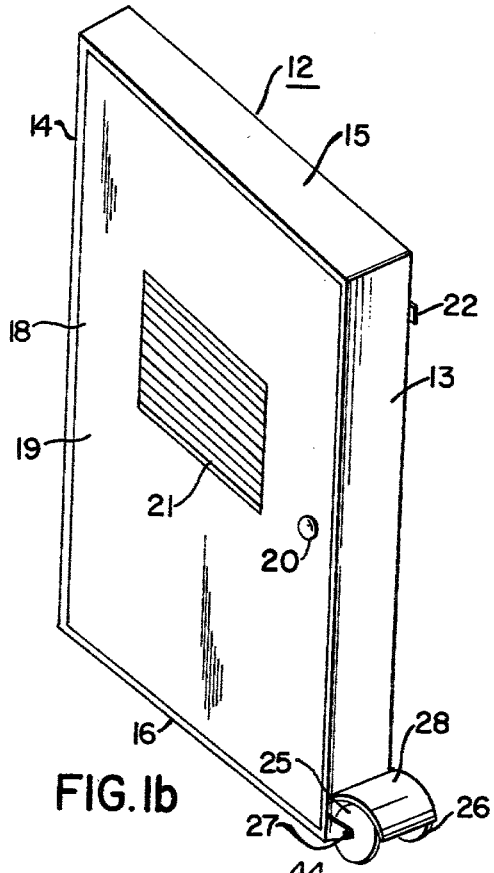

Referring first to FIGS. 1*a* and 1*b,* the garage of our invention comprises an open rectangular frame 12 having vertical left and right side walls 13 and 14 and horizontal top and bottom walls 15 and 16 respectively. The frame has a vertical open front surface 17 and a vertical rear surface 18 comprising a rear door panel 19 having a knob 20 and air vent 21 mounted thereon.

Various panels which fold away from the frame 12 to form the enclosure of the garage, are stored within said frame, the outermost panel being retained in position by pivotable latch bars 22 and 23.

The frame 12 and the garage panels folded therein, is moved by means of a handle 24 and wheels 25 and 26 mounted on a common axle 27. An arcuate fender 28 extends over the wheels 25 and 26 to provide environmental protection.

The rear door panel 19 is pivotally mounted to the frame 12 by upper and lower vertically aligned hinges 29 and 30, so that the door panel 19 rotates about a vertical axis parallel to the side walls 13 and 14. A door latch (not shown) in the left side wall 13 engages a latch member associated with the door knob 20 to maintain the door 19 in its closed position.

Figure 4:
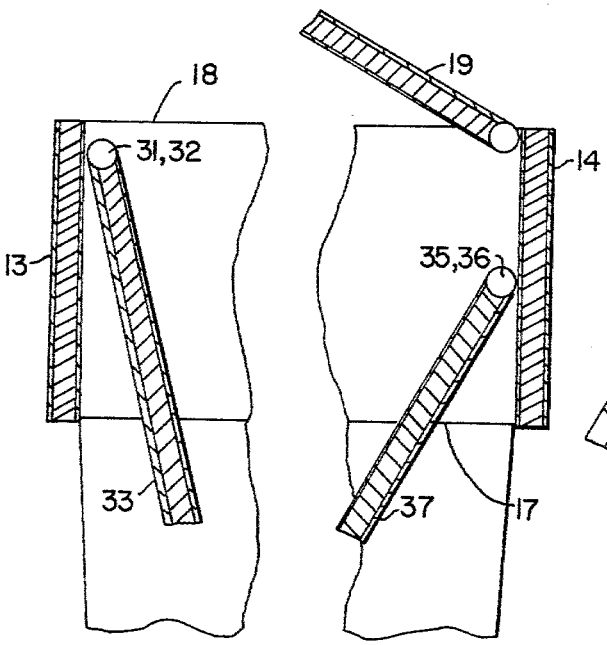
FIG. 4 is a partially cut away top cross-sectional plan view showing the hinge locations of the left and right side members and rear door of said motorcycle garage.

Each of the walls 13 to 16 has a hinge means associated therewith for supporting a corresponding foldable member of the garage. As best seen in FIG. 2, a first vertically oriented hinge means 31, 32 is mounted within the frame 12 adjacent the left side wall 13, for supporting the left side member comprising panels 33 and 34. A second vertically oriented hinge means 35, 36 mounted within the frame 12 adjacent the right side wall 14 supports the right side member comprising panels 37, 38, and a front door panel 39. As best seen in FIG. 4, the hinge means 31, 32 and 35, 36 are disposed different distances from the front surface 17 of the frame 12.

A third horizontally oriented hinge means 40, 41 is mounted within the frame 12 adjacent the top side wall 15, for supporting the roof member comprising panels 43 and 44.

A fourth horizontally oriented hinge means 45, 46 is mounted within the frame 12 adjacent the bottom wall 16, for supporting a floor member comprising plywood panels 47 and 48.

Figure 3A:
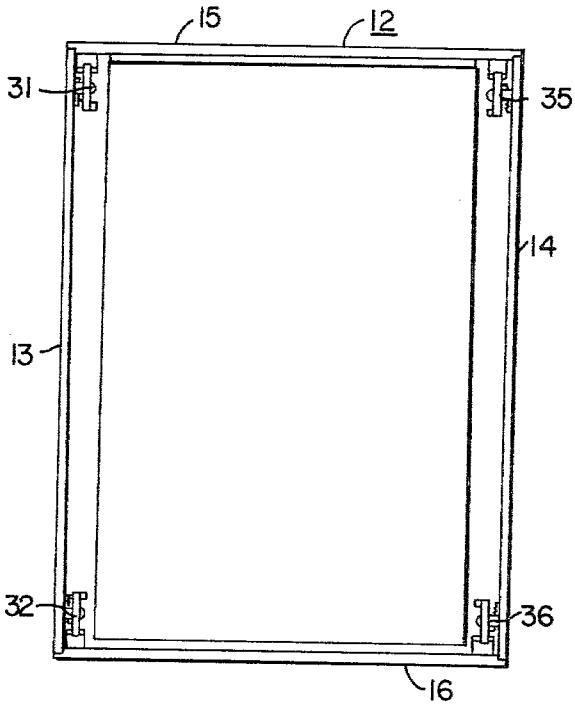
Figure 3B:
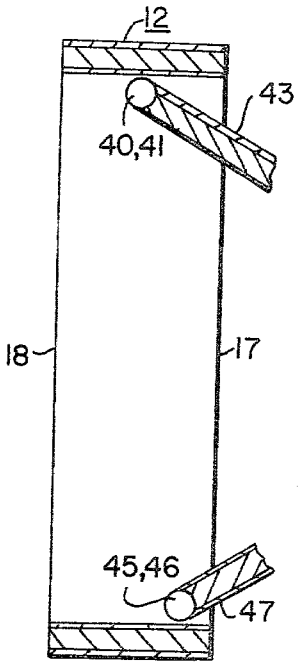

As best seen in FIG. 3*b*, the hinge means 40, 41 and 45, 46 are disposed at different distances from the front surface 17 of the frame 12.

The hinges 49, 50, and 51 joining the panels 33/34, 37/38 and 38/39 respectively, are vertical; whereas the hinges 52 and 53 joining the panels 43/44 and 47/48 respectively, are horizontal.

Figure 2A:
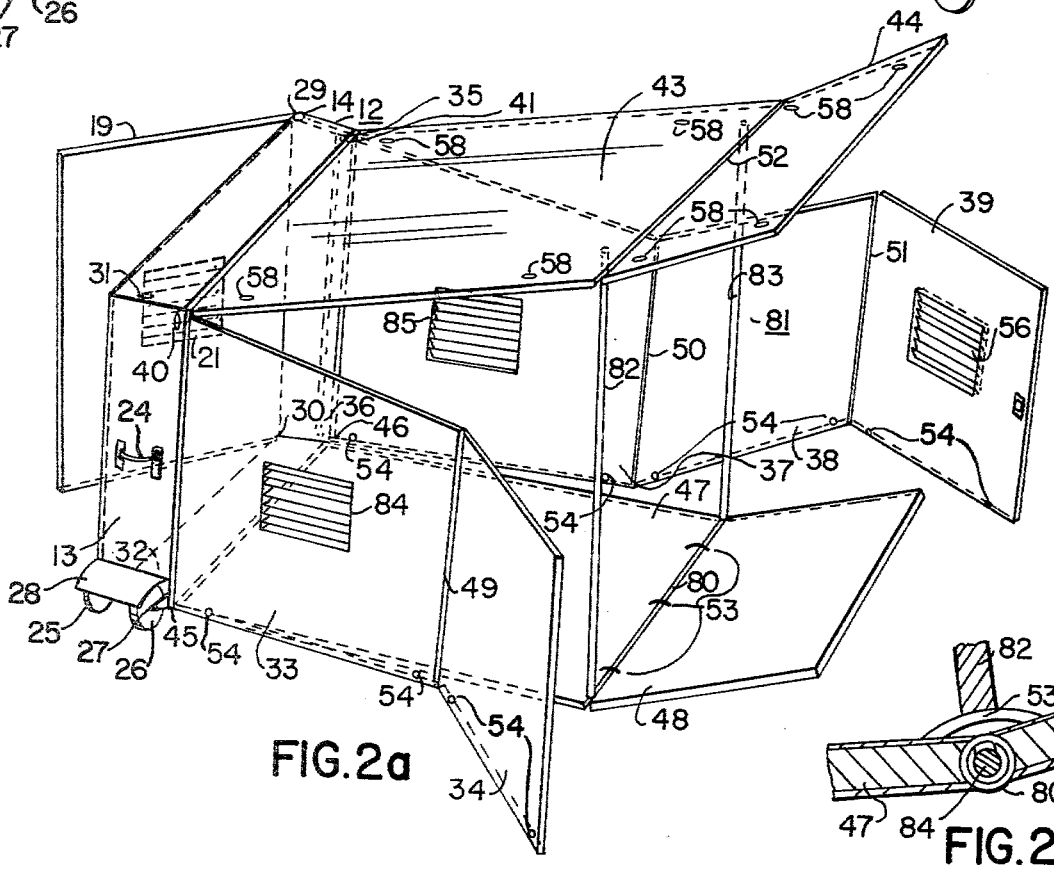
Figure 2B:
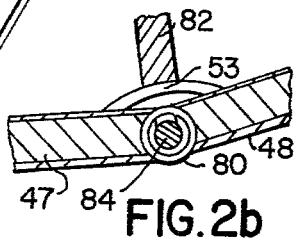

As shown in FIGS. 2*a* and 2*b*, a hollow supporting tube 80 is disposed between the floor panels 47 and 48 in juxtaposition with the hinge 53. A U-shaped tubular roof support bar 81 comprises parallel arms 82 and 83 and an interconnecting pivot arm 84. The interconnecting arm 84 (see FIG. 2*b*) is coaxially disposed within and rotatable with respect to the hollow supporting tube 80, to permit the bar 81 to be raised and lowered to facilitate erection of the enclosure.

In the raised position the free upper ends of the arms 82 and 83 engage corresponding cylindrical recesses in the lower surface of the roof panel 43, to temporarily support said roof panel (during the erection or assembly operation) at a height slightly above the final desired height thereof.

Just before the roof panel 43 is latched to the side panels 33 and 37 as hereafter described, the bar 81 is lowered by rotating the same (the interconnecting arm 84 rotating within the hollow tube 80) so that the arms 82 and 83 are horizontal and rest on the floor panel 47 along the left and right side edges thereof.

The panels 33 and 37 are preferably trapezoidal, with the upper and lower edges of each panel being tapered toward each other so that the length of each panel measured along the corresponding hinge 49 or 50 is less than its length measured along the corresponding hinge 31/32 or 29/30. The other panels are quadrilateral, with the panels 34 and 38 preferably (but not necessarily) being trapezoidal.

Figure 9:
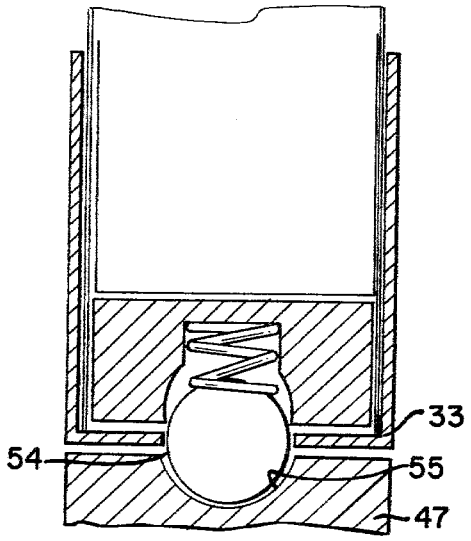
FIG. 9 is a cross-sectional view of a ball detent mechanism utilized in said garage.

Each of the side panels 33, 34, 37 and 38 rolls on a pair of ball bearing detent mechanisms (each mechanism being designated by the numeral 54), which facilitate low friction unfolding of said side members and provide a detent action with corresponding recesses adjacent the side edges of the floor panels 47 and 48, to retain the lower edges of the side panels 33, 34, 37 and 38 in proper alignment therewith in the open position of said side panels. The ball detent mechanism 54 is shown in greater detail in FIG. 9.

The front door panel 39 has an air louver 56 for permitting air to flow through the garage enclosure between the louvers 56 and 21. Additional vents 84 and 85 in the side panels 33 and 37 respectively enhance the ventilation through the enclosure.

To erect the garage, the four member panels 47 and 48 are unfolded first to form the floor; then the roof member panels 43 and 44 are unfolded, followed by unfolding of the right side member and front door panels 37, 38 and 39; and finally the left side member panels 33 and 34 are unfolded.

The side member panels 33, 34, 37 and 38 are than pivoted outward by rolling of the ball bearing detents 54 on the floor panels 47 and 48, until each ball bearing detent 34 engages a corresponding recess 55 of one of the floor panels 47, 48.

Figure 5:
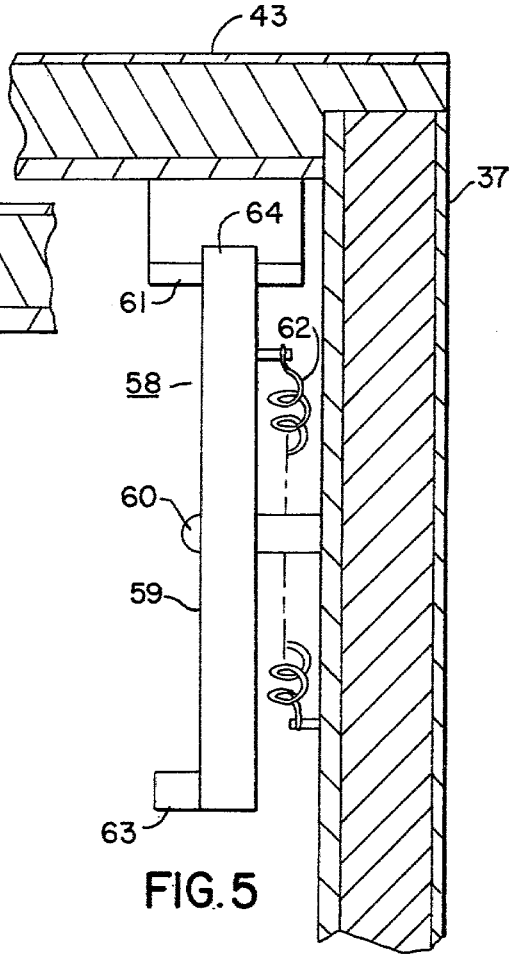
FIG. 5 is a cross-sectional view of adjacent side and top panels, showing the latching mechanism for detachably securing the same to each other.

Thereafter the upper edges of the side members 33, 34, 37 and 38 are brought into alignment with the side edges of the roof panels 43 and 44 (see FIG. 5), and the adjacent edges are held in mutual engagement by latches 58 (see FIG. 5).

Figure 6:
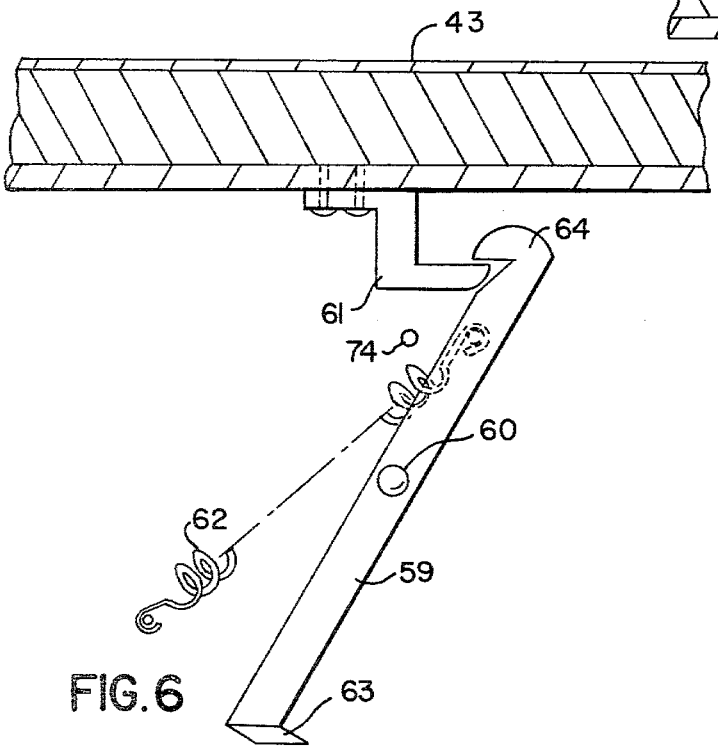
FIG. 6 shows a side view of the latching arrangement of FIG. 5.

As best seen in FIGS. 5 and 6, each of the latches 58 comprises a lever 59 pivotally mounted for rotation in a vertical plane about a horizontal pivot pin 60. The lever 59 is urged toward a pawl 61 affixed to one of the roof panels 43, 44, by a spring 62. The lever 59 has an extension 63 on the lower end thereof for facilitating manual disengagement of the lever 59 and pawl 61; and a hook portion or member 64 at the upper end thereof for detachably engaging the pawl 61.

Figure 7:
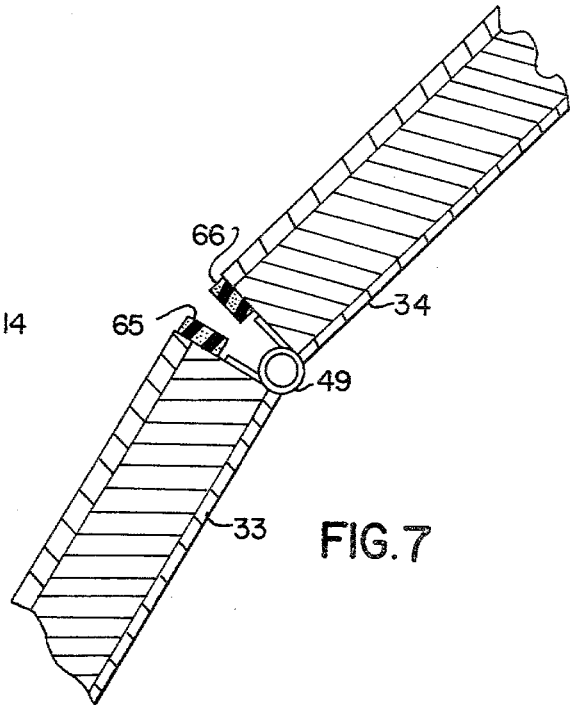
FIG. 7 is a cross-sectional view of the region of a hinge between adjacent panels.

The abutting edges of the panels 33 and 34, 37 and 38, 38 and 39, 43 and 44, and 47 and 48, are provided with resilient weatherstrip members 65, 66 (see FIG. 7), to provide a weathertight seal therebetween when the panels are moved to their aligned positions to form the motorcycle garage enclosure.

Figure 10:
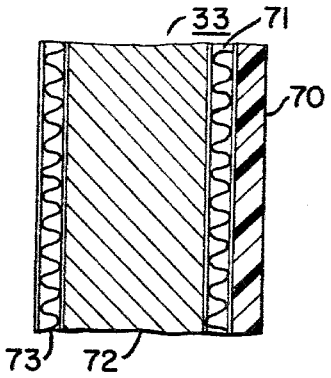
FIG. 10 is a cross-sectional view showing the structure of the panels utilized in said garage.

Each of the panels 33, 34, 37, 38, 39, 43 and 44 (as well as the rear door panel 19 if so desired) has the lightweight, high strength construction shown in FIG. 10; and each of said panels is further strengthened by a surrounding U-shaped frame, preferably of aluminum extruded U-channel. The floor panels 47 and 48 are preferably made of ½ inch exterior plywood.

As shown in FIG. 10, the construction of a typical one of the panels 33 comprises an outer layer 70 of a laminated plastic such as Formica, an intermediate layer 71 of waxed pressed board; a core 72 of polyurethane foam, and an inner layer 73 of waxed pressed board. The various layers are secured to each other by a suitable glue or other bonding agent. The resulting structure is economical, light in weight, and strong.

Typically, the layer 70 may have a thickness on the order of 1/16 inch; the layers 71 and 73 may be on the order of ⅛ inch thick; and the core 72 may have a thickness on the order of ⅝ inch.

In addition to increasing the bending strength of the panel, the core 72 also provides a substantial insulation effect, thus protecting a motorcycle within the enclosure formed by the various panels from extremes of temperature.

Figure 8:
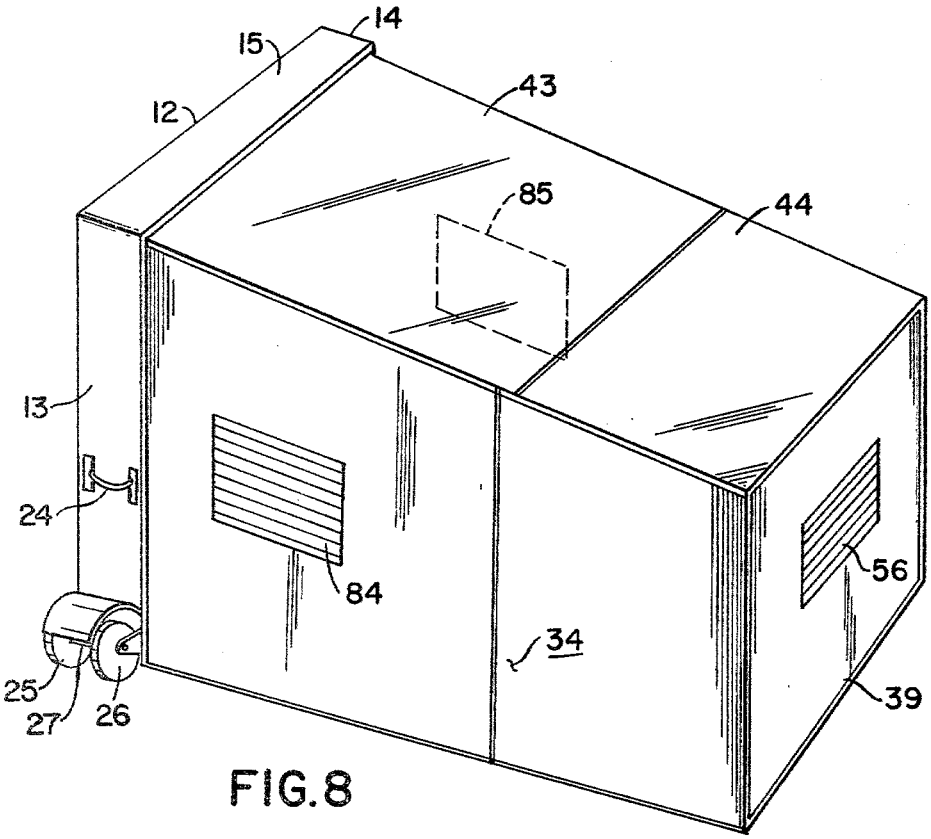
FIG. 8 is a perspective view of said motorcycle garage in assembled configuration.

The resulting assembled structure, shown in FIG. 8, has a truncated pyramidal structure to provide efficient enclosure of a motorcycle, and a pleasing external appearance.

To fold up the motorcycle garage into the configuration shown in FIGS. 1*a* and 1*b* for transporting the same, with the panel 48 providing a closure therefor, the latches 58 are actuated by means of the portions 63 thereof to disengage the hook portions 64 from the pawls 61, such disengagement as well as smooth operation of the latch mechanism being facilitated by the stop pin 74, which limits the travel of the hook portion 64 in the direction of the pawl 61.

After the latches 58 are disengaged, the bar 81 is rotated to raise the arms 82 and 83 to engage the cylindrical recesses within the lower surface of the roof panel 43, thus raising the roof member and temporarily supporting it during the disassembly operation. Then the left side panels 33 and 34 are folded into the frame 12, followed by folding of the right side panels 37, 38 and 39 into said frame. The bar 81 is then lowered and the roof panels 43 and 44 are folded into the frame 12, after which the plywood floor panels 47, 48 are folded therein, so that the bottom portion of the floor panel 47 provides a closure for the open surface 17 of the frame 12. The holding elements 22 and 23 are then rotated to hold the panels in position within the frame 12, and the rear door 19 (if open) is closed and latched shut.

What we claim is:

1. A portable motorcycle garage, comprising:

an open rectangular frame having vertical left and right side walls and horizontal top and bottom walls, a vertical open front surface and a vertical rear surface;

first vertically oriented hinge means mounted within said frame adjacent said left side wall;

second vertically oriented hinge means mounted within said frame adjacent said right side wall, said first and second hinge means being disposed different distances from said front surface;

third horizontally oriented hinge means mounted within said frame adjacent said top wall;

fourth horizontally oriented hinge means mounted within said frame adjacent said bottom wall, said third and fourth hinge means being disposed different distances from said front surface;

a roof member comprising first and second generally rectangular panels hinged together by a roof hinge parallel to said third hinge means, an edge of said first panel being attached to said third hinge means;

a floor member comprising third and fourth generally rectangular panels hinged together by a floor hinge parallel to said fourth hinge means, an edge of said third panel being attached to said fourth hinge means;

a left side member comprising fifth and sixth panels hinged together by a left side hinge parallel to said first hinge means, an edge of said fifth panel being attached to said first hinge means, said fifth panel being generally trapezoidal and said sixth panel being quadrilateral;

a right side member comprising seventh and eighth panels hinged together by a right side hinge parallel to said second hinge means, an edge of said seventh panel being attached to said second hinge means, said seventh panel being generally trapezoidal and said eighth panel being quadrilateral;

a front door panel hinged to one of said sixth and eighth panels by a front door hinge parallel to a corresponding one of said first and second hinge means;

latching means for detachably securing to each other adjacent edges of said panels to form a motorcycle enclosure having a front end accessible via said front door and a rear end defined by said frame;

means for closing the rear surface of said frame;

vent means for permitting air to flow through said enclosure; and weatherstrip means for sealing the edges of said panels adjacent said hinges;

said hinge means, panels and front door being positioned and dimensioned to fold into said frame with one of said panels being relatively proximate to said front vertical surface and providing a closure therefor.

2. A portable motorcycle garage according to claim 1, wherein said first through eighth panels each comprise a U-shaped aluminum frame, and a sheet secured within said U-shaped frame, said sheet comprising an outer layer of plastic laminate, an adjacent layer of waxed pressed board, another layer of waxed pressed board adjacent the interior of said enclosure, and a layer of insulating foam between said layers of waxed pressed board.

3. A portable motorcycle garage according to claim 1, further comprising spring-loaded ball bearing detent means in the bottom edges of said left side and right side members for providing rolling support for said side members and for engaging corresponding detent recesses in said floor member.

4. A portable motorcycle garage according to claim 1, wherein said rear surface closing means comprises a rear door panel hinged to one of said side walls of said frame.

5. A portable motorcycle garage according to claim 1, wherein said vent means comprises a first vent in said front door panel and a second vent in said rear surface closing means.

6. A portable motorcycle garage according to claim 1, wherein said latching means comprises a plurality of latch assemblies each comprising a pawl member on one panel, a hook member on an adjacent panel for engaging said pawl member, a spring for urging said hook member toward said pawl member, and a stop pin for limiting the movement of said hook member in the direction of said pawl member when said hook and pawl members are not engaged.

7. A portable motorcycle garage according to claim 1, further comprising an axle mounted to the outside of said frame on one of said side walls near said bottom wall, and wheel means rotatably mounted on said axle for facilitating movement of said frame.

8. A portable motorcycle garage according to claim 1, further comprising a hollow supporting tube mounted between said third and fourth panels in juxtaposition with said floor hinge, and a U-shaped bar having two parallel arms and a tubular interconnecting arm rotatably disposed within said supporting tube, for facilitating erection and disassembly of said garage.

9. A portable enclosure, comprising:

an open rectangular frame having vertical left and right side walls and horizontal top and bottom walls, a vertical open front surface and a vertical rear surface;

first vertically oriented hinge means mounted within said frame adjacent said left side wall;

second vertically oriented hinge means mounted within said frame adjacent said right side wall, said first and second hinge means being disposed different distances from said front surface;

third horizontally oriented hinge means mounted within said frame adjacent said top wall;

fourth horizontally oriented hinge means mounted within said frame adjacent said bottom wall, said third and fourth hinge means being disposed different distances from said front surface;

a roof member comprising first and second generally rectangular panels hinged together by a roof hinge parallel to said third hinge means, an edge of said first panel being attached to said third hinge means;

a floor member comprising third and fourth generally rectangular panels hinged together by a floor hinge parallel to said fourth hinge means, an edge of said third panel being attached to said fourth hinge means;

a left side member comprising fifth and sixth panels hinged together by a left side hinge parallel to said first hinge means, an edge of said fifth panel being attached to said first hinge means, said fifth panel being generally trapezoidal and said sixth panel being quadrilateral;

a right side member comprising seventh and eighth panels hinged together by a right side hinge parallel to said second hinge means, an edge of said seventh panel being attached to said second hinge means, said seventh panel being generally trapezoidal and said eighth panel being quadrilateral;

a front panel hinged to one of said sixth and eighth panels by a front hinge parallel to a corresponding one of said first and second hinge means;

latching means for detachably securing to each other adjacent edges of said panels to form an enclosure having a front end defined by said front panel and a rear end defined by said frame; and means for closing the rear surface of said frame;

said hinge means and panels being positioned and dimensioned to fold into said frame with one of said panels being relatively proximate to said front vertical surface and providing a closure therefor.

10. The portable enclosure according to claim 9, further comprising vent means for permitting air to flow through said enclosure, and weatherstrip means for sealing the edges of said panels adjacent said hinges.

11. A portable enclosure according to claim 9, wherein said latching means comprises a plurality of latch assemblies each comprising a pawl member on one panel, a hook member on an adjacent panel for engaging said pawl member, a spring for urging said hook member toward said pawl member, and a stop pin for limiting the movement of said hook member in the direction of said pawl member when said hook and pawl members are not engaged.

12. A portable enclosure according to claim 9, further comprising a hollow supporting tube mounted between said third and fourth panels in juxtaposition with said floor hinge, and a U-shaped bar having two parallel arms and a tubular interconnecting arm rotatably disposed within said supporting tube, for facilitating erection and disassembly of said enclosure.

* * * * *